US006685443B2

(12) United States Patent
Simmons et al.

(10) Patent No.: US 6,685,443 B2
(45) Date of Patent: Feb. 3, 2004

(54) PNEUMATIC RECIPROCATING PUMP

(76) Inventors: John M. Simmons, 5650 N. Smith Rd., Henderson, MI (US) 48841; Tom M. Simmons, 3670 N. Raucholz Rd., Hemlock, MI (US) 48626; David M. Simmons, 15010 Frost Rd., Hemlock, MI (US) 48626

( * ) Notice: Subject to any disclaimer, the term of this patent is extended or adjusted under 35 U.S.C. 154(b) by 17 days.

(21) Appl. No.: 10/191,100

(22) Filed: Jul. 9, 2002

(65) Prior Publication Data

US 2003/0012668 A1 Jan. 16, 2003

Related U.S. Application Data

(60) Provisional application No. 60/304,678, filed on Jul. 11, 2001.

(51) Int. Cl.[7] ..... F04B 43/06; F04B 45/00

(52) U.S. Cl. ..... 417/395; 417/374; 417/393

(58) Field of Search ..... 417/374, 384, 417/395, 393, 375

(56) References Cited

U.S. PATENT DOCUMENTS

| | | | | | |
|---|---|---|---|---|---|
| 1,161,787 | A | | 11/1915 | Nickol | |
| 3,741,689 | A | * | 6/1973 | Rupp | 417/393 |
| 3,791,768 | A | | 2/1974 | Wanner | |
| 3,838,946 | A | * | 10/1974 | Schall | 417/395 |
| 4,386,888 | A | * | 6/1983 | Verley | 417/393 |
| 4,496,294 | A | | 1/1985 | Frikker | |
| 4,548,551 | A | * | 10/1985 | Ruttenberg et al. | 417/393 |
| 4,566,867 | A | | 1/1986 | Bazan | |
| 4,927,335 | A | | 5/1990 | Pensa | |
| 4,983,104 | A | | 1/1991 | Kingsford | |
| 5,174,731 | A | | 12/1992 | Korver | |
| 5,224,841 | A | | 7/1993 | Thompson | |
| 5,232,352 | A | * | 8/1993 | Robinson | 417/393 |
| 5,277,555 | A | * | 1/1994 | Robinson | 417/393 |
| 5,326,234 | A | | 7/1994 | Versaw | |
| 5,558,506 | A | | 9/1996 | Simmons | |
| 5,649,813 | A | * | 7/1997 | Able et al. | 417/387 |
| 5,707,217 | A | * | 1/1998 | Loeffler | 417/339 |
| 5,893,707 | A | | 4/1999 | Simmons | |
| 6,004,105 | A | * | 12/1999 | Reynolds | 417/53 |

* cited by examiner

*Primary Examiner*—Justine R. Yu
*Assistant Examiner*—William H. Rodriguez

(57) ABSTRACT

A pneumatically-actuated reciprocating fluid pump and shuttle valve combination operates in an "air-assist" mode and a "non-air-assist" mode. In the non-air-assist mode, the shuttle valve is shifted by a blast of pressurized supply air from the pneumatic chamber in its pumping stroke as the flexible diaphragms and drive shaft reach the end of their pumping stroke. This blast of pressurized air used to shift the shuttle valve has the effect of reducing the air pressure in the pneumatic chamber immediately prior to the point in time that the drive shaft reaches the end of its stroke in order to provide a cushioning effect at the end of each pumping strokes cycle, in order to lessen the effect of the drive shaft and diaphragms abruptly reversing direction at full air pressure. In the air-assist mode, a secondary source of compressed air is utilized to shift the shuttle valve, rather than drawing pressurized air from the pneumatic chamber during its pumping stroke. In the air-assist mode, the full effect of the pressurized air to the pump is directed to pump fluid through the pump, and is not lessened by tapping a minute amount compressed air at the end of each pumping stroke cycle for shifting the shuttle valve.

18 Claims, 15 Drawing Sheets

PNEUMATIC RECIPROCATING PUMP

CROSS-REFERENCE TO RELATED APPLICATIONS

This application claims the priority benefit of 35 USC §119 of U.S. provisional application Serial No. 60/304,678, filed Jul. 11, 2001, entitled Pneumatic Reciprocating Pump, hereby incorporated herein by reference in its entirety.

STATEMENT REGARDING FEDERALLY SPONSORED RESEARCH OR DEVELOPMENT

Not applicable.

BACKGROUND OF THE INVENTION

1. Field of the Invention

The present invention relates to a pneumatically-operated reciprocating fluid pump and shuttle valve shifting mechanism, and more particularly relates to a pneumatically-operated reciprocating fluid pump that utilizes bleed pneumatic pressure from the supply fluid (typically compressed air) to shift the shuttle valve.

2. Description of the Prior Art

Pneumatically-actuated reciprocating pumps are well known in the fluid industry. Such reciprocating fluid pumps are operated by a shuttle valve which shifts pressurized air from one pneumatic chamber of the pneumatic reciprocating pump to the other as the pumping means (flexible diaphragm, piston, bellows, etc.) reaches the end of its pumping stroke. A valve spool in the shuttle valve shifts between two positions which alternately supply pressurized air to the pneumatic chamber of one side of the pump while simultaneously permitting the other pneumatic chamber to exhaust the air therefrom. Reciprocation of the valve spool alternates this pressurized air/exhaust between pairs of pneumatic chambers within the pneumatically-actuated reciprocating pump, thereby creating the reciprocating pumping action of the pump.

Most pneumatically-operated reciprocating fluid pumps are, in fact, dual reciprocating pumps, meaning that the pump incorporates two pumping means (diaphragm, etc) that reciprocate in a manner such that the intake (suction) stroke of one pumping means (flexible diaphragm) is the exhaust (pressure) stroke of the other pumping means. In this manner, the dual reciprocating action of the diaphragms, etc. pump liquid from a first pumping chamber as liquid is being drawn into the second pumping chamber, followed by the reverse action of the two diaphragms, which pumps liquid from the second pumping chamber while drawing liquid to be pumped into the first pumping chamber.

A common problem with these dual-reciprocating fluid pumps is that as the drive shaft connecting the two flexible diaphragms, and therefore the diaphragms themselves, reaches the end of its pumping stroke, the abrupt change (reversal) in direction of the drive shaft and diaphragms generates vibration of the pump. These repeated abrupt reversals of direction (in both directions) of the drive shaft and diaphragms not only vibrate the pump, connections, and fluid conduits within the system, they also prematurely destroy the diaphragm and drive shaft, necessitating frequent replacement of the diaphragms and drive shaft.

Prior art pneumatically-actuated reciprocating fluid pumps have also consistently had problems with pumped-fluid surge as pumped fluid from one pumping chamber abruptly stops and fluid from the opposite pumping chamber abruptly starts. This surge causes what is termed hydraulic hammering in supply lines that tends to vibrate the lines, resulting in unnecessary abrasion, flexure, and fatigue in the lines, and also tends to vibrate the fluid connections and fittings loose near the pump. In certain applications, surge can dislodge particulate contamination or other particulate matter from the pump construction material (e.g., Teflon) and introduce this contamination into the fluid system.

SUMMARY OF THE INVENTION

A pneumatically-shifted reciprocating fluid pump is shifted by a pneumatically-shifted shuttle valve, the shuttle valve being shifted to reciprocate the pumping means of the pump by reciprocating pneumatic pressure within the pump alternately between the two pneumatic chambers. The present invention extends the life of the flexible diaphragms and drive shaft by minimizing the effect of the drive shaft and diaphragms abruptly reversing direction as the drive shaft and diaphragms reach the end of their pumping stroke. It does this by "stealing" a blast of supply air from the pressurized pneumatic chamber to shift the shuttle valve to its opposite position to reverse the feed of pressurized air and exhaust to the two pneumatic chambers of the fluid pump. This "stolen" supply of pressurized air from the pressurized pneumatic chamber decreases the pressure in the pneumatic chamber, thereby decreasing the force applied to the drive shaft, causing the drive shaft and diaphragms to slow down as the drive shaft nears the end of its stroke, due to the pressure differential between the back pressure of the pumped fluid in the pressurized pumping chamber and the sudden decrease of pressure in the pneumatic chamber.

A valve mechanism is formed by the pump body and the drive shaft and connects the two diaphragms, etc. in their respective pneumatic chambers. This valve mechanism steals these blasts of compressed air supplied from the pressurized side of the pneumatic chamber and directs them to the appropriate end of the shuttle valve to shift the shuttle valve in the opposite direction. Specifically, the drive shaft includes two annular grooves that provide communication between the pressurized pneumatic chamber and the appropriate end of the shuttle valve as the drive shaft nears the end its stroke and the drive shaft annular groove passes over a drive shaft bore shift port and a shuttle valve shift port, establishing communication between the two. In this manner, as the drive shaft nears the end of its stroke, the pressurized pneumatic chamber is relieved of some of its pressure (this "relieved" pressurized air being used to shift the shuttle valve), thereby slightly reducing the pressure in the pressurized pneumatic chamber in order to decelerate the drive shaft, and therefore the two diaphragms, as the drive shaft and diaphragms approach the end of this pumping stroke half-cycle.

The reciprocating pump operates in an "air-assist" mode and a "non-air-assist" mode. In the non-air-assist mode (as just described), the shuttle valve is shifted by a blast of pressurized supply air from the pneumatic chamber in its pumping stroke as the diaphragms and drive shaft reach the end of their pumping stroke. This blast of pressurized air used to shift the shuttle valve has the effect of reducing the air pressure in the pneumatic chamber immediately prior to the point in time that the drive shaft reaches the end of its stroke in order to provide a cushioning effect at the end of each pumping strokes cycle, in order to lessen the effect of the drive shaft and diaphragms abruptly reversing direction at full air pressure.

In the air-assist mode (in which higher sustained pumping pressures are required), shifting of the shuttle valve is provided by a separate "air-assist". In this mode, a secondary source of compressed air is utilized to shift the shuttle valve, rather than drawing pressurized air from the pneumatic chamber during its pumping stroke. In the air-assist mode, full pressure air is available to pump fluid through the pump, and is not lessened by tapping a minute amount of compressed air at the end of each pumping stroke for shifting the shuttle valve. In addition, in the air-assist mode, the external pressurized air source can be at a much lower pressure than the pressurized air used to drive the pump, resulting in the use of a much smaller and/or less substantial (and therefore, less expensive) shuttle valve being useable in the system. Also, of course, running shuttle valves at lower operating pressures will prevent premature degradation of the valves themselves, as opposed to shuttle valves having to be run at the much higher pump-pressure. In the commercial embodiment of the fuel pump, shifting between the air-assist mode and non-air-assist mode is easily accomplished by switching a screw-plug between two designs for each fluid pump pneumatic chamber and providing the secondary air source for the shuttle valve shift air.

DETAILED DESCRIPTION OF THE INVENTION

Figure 1:
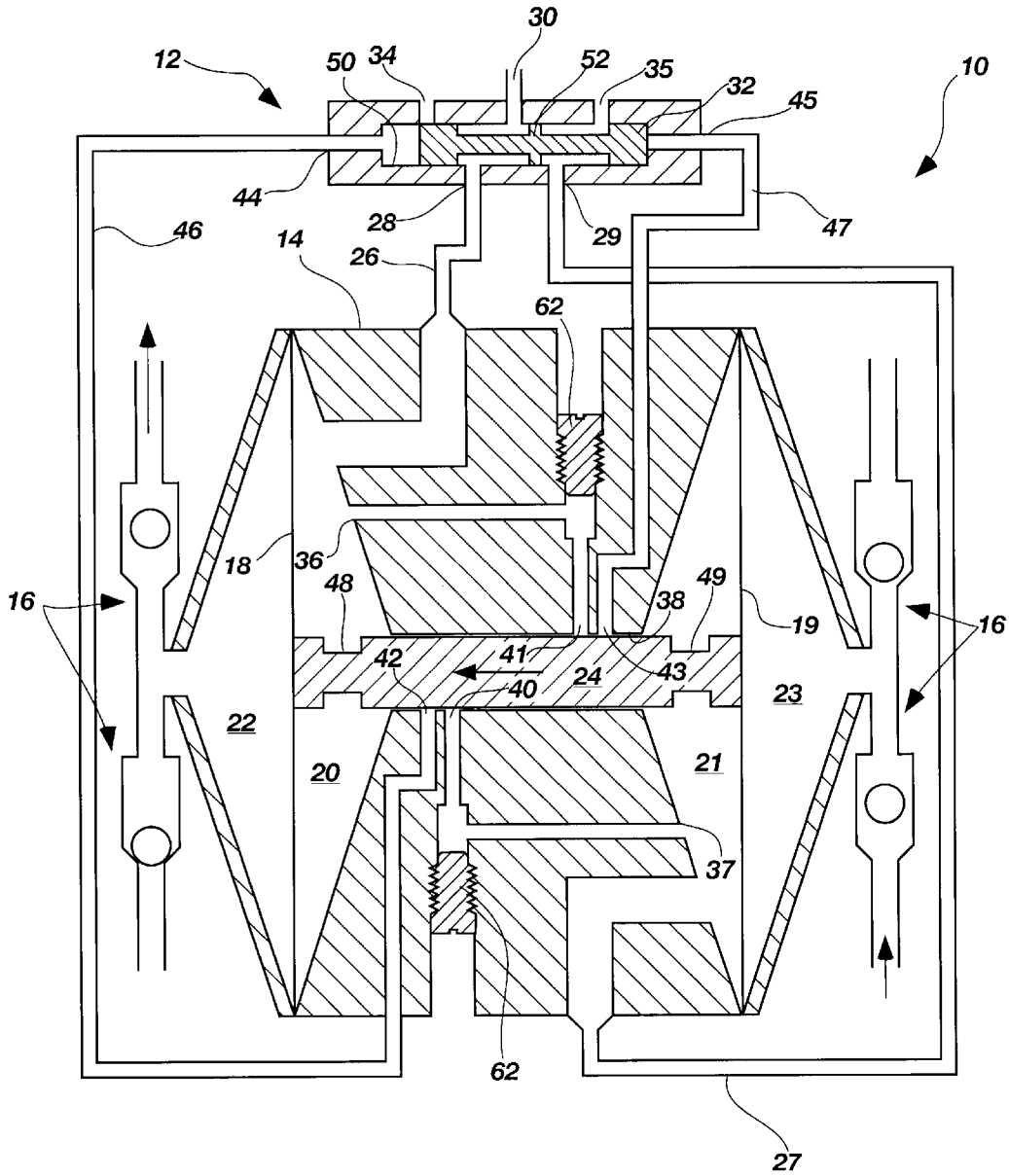
FIG. 1 is a schematic drawing of a first embodiment of the pneumatically-shifted reciprocating fluid pump and pneumatically-shifted shuttle valve, both shown in section, illustrating the pump and shuttle valve in a first of four sequential pumping cycles.

Turning now to the drawings, and initially to FIG. 1, a pneumatically-actuated, dual opposed-diaphragm reciprocating fluid pump 10 and its associated shuttle valve 12 are shown schematically and in section to more easily understand the structure and operation. The reciprocating fluid pump 10 is, in essence, a conventional, 4-cycle, 2-stroke, dual-reciprocating diaphragm pump actuated by pneumatic positive air pressure. External sections of the fluid pump 10 include unidirectional flow mechanisms 16 for admitting the fluid to be pumped into the fluid pump and directing the pumped fluid out of the pump. These unidirectional flow mechanisms 16 are shown schematically as floating ball-type check valves, but, of course, may be any form of unidirectional flow mechanism that functions to channel pumped fluid in one direction through the fluid pump. For purposes of reference, fluid flow through the fluid pump is from bottom to top in the drawings.

The fluid pump 10 includes identical, reciprocating left and right flexible diaphragms 18, 19, respectively, that are positioned within respective left and right sections of the pump housing. These respective flexible diaphragms 18, 19 define respective left and right pneumatic chambers 20, 21 and pumping chambers 22, 23. The two diaphragms 18, 19 are connected together by a drive shaft 24 which enables the diaphragms to reciprocate together within the fluid pump housing 14 in a customary manner.

The fluid pump 10 is actuated by pneumatic pressure provided by respective left and right pneumatic air fill lines 26, 27, which alternately introduce pressurized air into the left and right pneumatic chambers 20, 21 from the shuttle valve 12 in a timed fashion to alternately shift the diaphragms 18, 19 to provide the reciprocating fluid pumping action of the pump. This alternating pneumatic pressure is provided through the shuttle valve 12 from respective left and right pneumatic supply ports 28, 29.

The shuttle valve 12 directs pneumatic air pressure from an air inlet port 30 alternately between the left and right pneumatic supply ports 28, 29 by the action of the shuttle valve spool 32 alternately reciprocating between its left and right positions. In addition, the shuttle valve 12 includes respective left and right exhaust ports 34, 35, which are adapted to exhaust air from the pneumatic chamber 20, 21 being compressed at the same time that air pressure is being fed to the opposite pneumatic chamber to expand same. This reciprocating pressurized air supply and exhaust is performed by the shuttle valve in a customary manner.

The foregoing is a brief description of a conventional pneumatically-actuated reciprocating pump and associated shuttle valve for alternately reciprocating the pneumatic air supply and exhaust between the two pneumatic chambers in order to reciprocate the two diaphragms within the pump to effect the pumping of fluid through the pump.

The present invention is directed to a novel mechanism for slowing down the diaphragms 18,19 and drive shaft 24 as the drive shaft nears the end of its pumping stroke. It accomplishes this by "stealing" compressed air from the respective pressurized pneumatic chamber 20, 21, and routing this blast of compressed air to the shuttle valve 12 in order to shift the shuttle valve for the subsequent cycle. This minute loss of air pressure at the end of the pressure stroke serves to slow down the diaphragms 18, 19 and drive shaft 24 to minimize the effect of the drive shaft and diaphragms abruptly reversing direction at full air pressure as the drive shaft and diaphragms reach the end of their pumping stroke.

Referring again to FIGS. 1–4, the invention includes the addition of respective left and right pressurized chamber bleed ports 36, 37 within respective pneumatic chambers 20, 21 that establish communication between respective left and right pneumatic chambers and the drive shaft bore 38 through the central section of the pump body at respective drive shaft bore shift ports 40, 41. Respective drive shaft bore shift ports 40, 41 are located in the drive shaft bore adjacent respective drive shaft bore shuttle valve shift ports 24, 42. The drive shaft 24 includes two identical annular grooves 48, 49 adjacent respective ends that alternatively establish communication between respective drive shaft bore shift ports 40, 41 and drive shaft bore shuttle shift ports 42, 43 (and therefore, shuttle valve shift ports 44, 45 at the respective ends of the shuttle valve spool 32 through respective shuttle valve shift lines 46, 47), such that when the drive shaft approaches the end of its pumping stroke, the appropriate drive shaft annular groove 48 or 49 establishes compressed air communication between the appropriate pressurized chamber bleed port 37, 36, the drive shaft bore shift ports 40, 41, drive shaft bore shuttle shift ports 42, 43, shuttle shift lines 46, 47, and the appropriate end of the shuttle valve spool, in order to cause this "stolen" blast of pressurized air from the pressurized pneumatic chamber 20, 21 to be applied to the appropriate (opposite) end of the shuttle valve spool to shift the shuttle valve to its opposite position. In addition, of course, this "stealing" of a blast of air from the pressurized pneumatic chamber 20, 21 reduces the pressure in the pneumatic chamber, thereby reducing the force applied to the appropriate diaphragm 18,19 and drive shaft, thereby causing the diaphragm and drive shaft to slow down under the resistance pressure of the pumped fluid in the opposite pumping chamber 23, 22, as the drive shaft nears the end of its pumping stroke.

FIG. 1 also illustrates the shuttle valve 12 shown for use with the pneumatically-actuated reciprocating fluid pump. The shuttle valve comprises a valve body defining the left and right pneumatic supply ports 28, 29, air inlet port 30, and left and right exhaust ports 34, 35. The shuttle valve spool 32 reciprocates within a spool bore 50 in a customary manner. The shuttle valve spool 32 includes three valve elements that function in a customary manner to reciprocate the air pressure and exhaust between respective pneumatic supply ports 28, 29, and therefore between respective fluid pump pneumatic chambers 20, 21. As is customary, the valve spool center element 52 reciprocates over the air inlet port 30 to alternately direct pressurized air between the pneumatic supply ports 28, 29.

The inventors have determined that by orienting the shuttle valve vertically, the shuttle valve spool 32 always drops to the bottom of the valve body when actuation air pressure at the inlet port is terminated. In this manner, gravity causes the shuttle valve to reset to the same operable position upon shutdown, whereby pressurized air subsequently introduced at the shuttle valve air inlet port 30 will always pass around the valve spool, through, for example, the left supply port 28 and into the pump left pneumatic chamber 20, to initiate pumping of the fluid pump. Because of the gravity reset of the shuttle valve spool, deadhead in the shuttle valve, and therefore the fluid pump, is always avoided.

The shuttle valve also includes the left and right shift ports 44, 45 which are adapted to receive alternate blasts of pressurized air in order to reciprocate the shuttle spool within the valve.

OPERATION

With reference again to FIGS. 1–4, the operation of the reciprocating fluid pump of the present invention will be explained. FIG. 1 illustrates the first stage of the pump and shuttle valve. High pressure air is introduced to the shuttle valve at the air inlet port 30, and passes through the valve to the left supply port 28, through the left air fill line 26, and into the left pneumatic chamber 20. The left pneumatic chamber 20 begins to fill under pneumatic pressure to expand, urging both diaphragms 18, 19 to the left. This is the pressure stroke of the left diaphragm 18 and intake stroke of the right diaphragm 19, evacuating liquid from the left pumping chamber 22 and drawing liquid into the right pumping chamber 23. This is shown in FIG. 2, which illustrates the second stage of the pump and shuttle valve.

Figure 2:
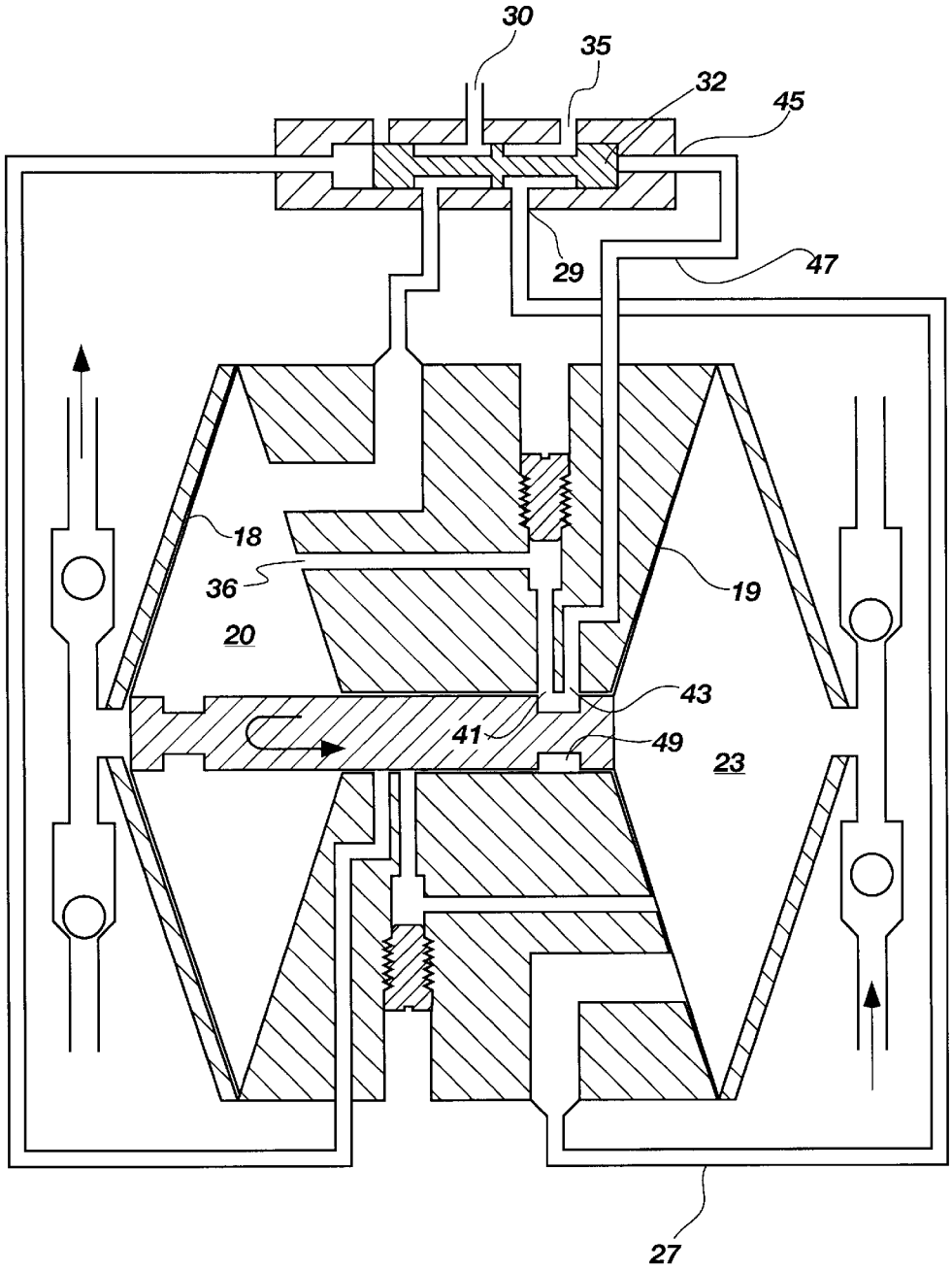
FIG. 2 is a schematic drawing similar to FIG. 1, illustrating the pump and shuttle valve in the second stage of the cycle.

As shown in FIG. 2, the shuttle valve spool 32 remains in its right position. Leftward movement of the left diaphragm 18 evacuates (pumps) fluid from the left pumping chamber 22 out the fluid pump exhaust. Leftward movement of the right diaphragm 19 draws fluid into the right pumping chamber 23 via the fluid pump intake. Leftward movement of the right diaphragm 19 also evacuates the right pneumatic chamber 21 through the right air fill line 27, the shuttle valve right pneumatic supply port 29, through the shuttle valve, and out the right exhaust port 35 to atmosphere.

Figure 3:
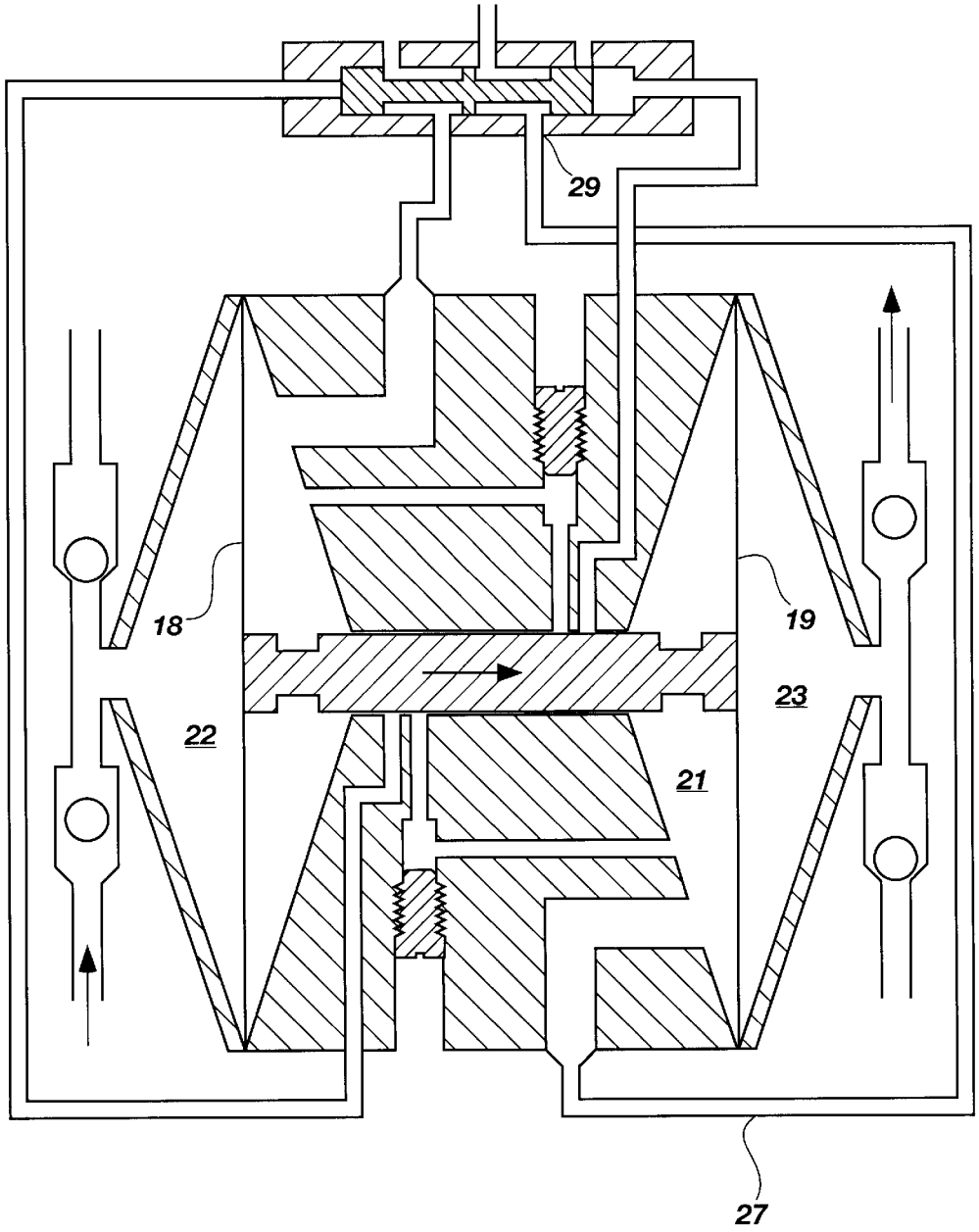
FIG. 3 is a schematic drawing similar to FIGS. 1 and 2, illustrating the pump and shuttle valve in the third stage of the cycle.

As the drive shaft and diaphragms 18, 19 travel to the left, the drive shaft right annular groove 49 aligns with both the right drive shaft bore shift port 41 and the right drive shaft bore shuttle shift port 43, thereby establishing communication between the pressurized left pneumatic chamber 20, through the left chamber bleed port 36, the drive shaft bore right shift port 41 and shuttle shift port 43, through the right shuttle shift line 47, and the shuttle valve right shift port 45, permitting a blast of pressurized air in the pump left pneumatic chamber 20, which is in its pressure stroke, to exhaust to the right shuttle valve shift port 45, where it shifts the shuttle valve spool to its left position. This shifts the shuttle valve and fluid pump to their third stage, as is shown in FIG. 3.

With the shuttle spool in its left position (FIG. 3), high pressure air through the inlet port is now directed to the right pneumatic supply port 29, through the right air fill line 27, and into the right pneumatic chamber 21. The right pneumatic chamber 21 begins to fill under pneumatic pressure to expand, urging both diaphragms 18, 19 to the right. This is the pressure stroke of the right diaphragm 19 and intake stroke of the left diaphragm 18, evacuating liquid from the right pumping chamber 23 and drawing liquid into the left pumping chamber 22. This is shown in FIG. 4, which illustrates the fourth stage of the pump and shuttle valve.

Figure 4:
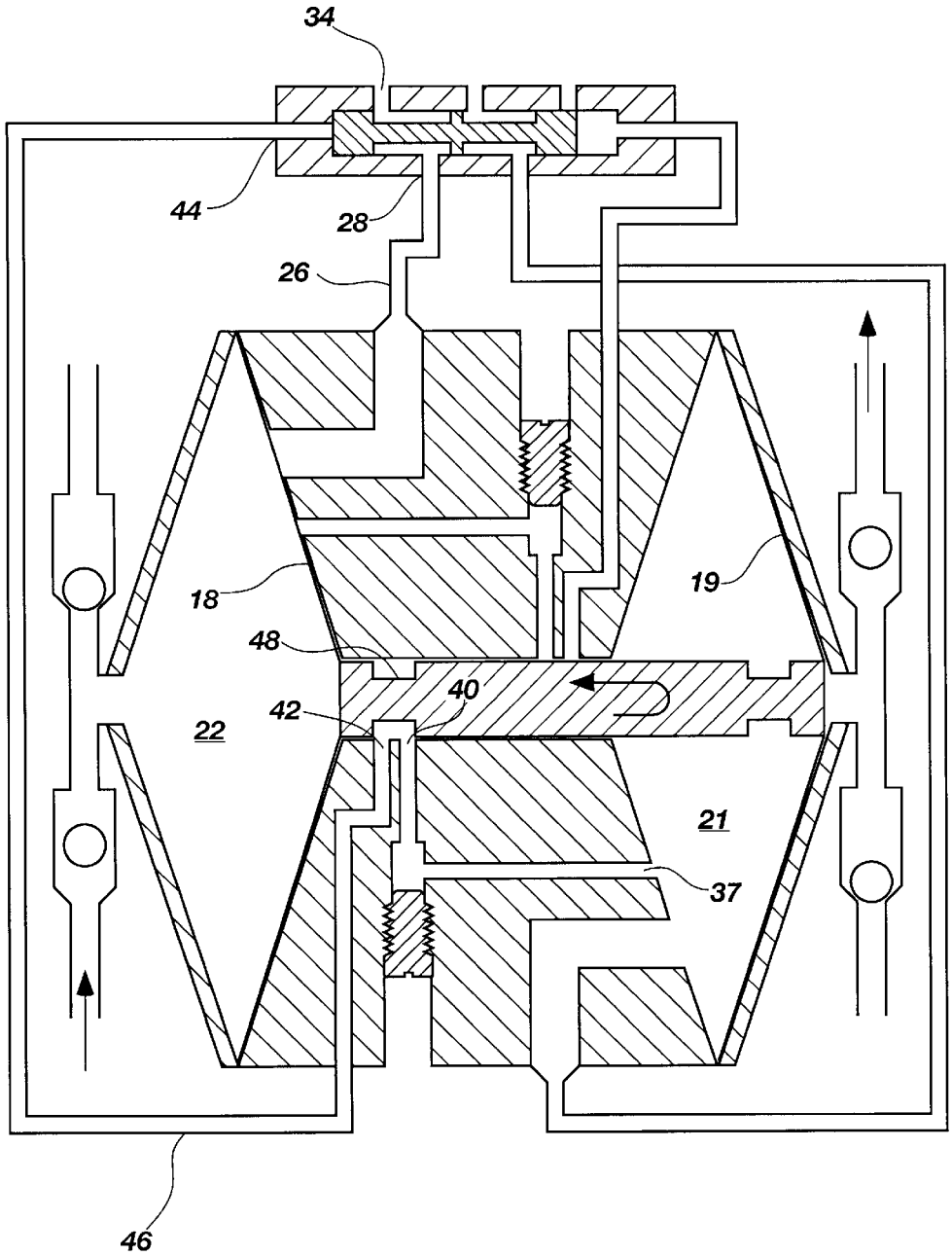
FIG. 4 is a schematic drawing similar to FIGS. 1–3, illustrating the pump and shuttle valve in the fourth stage of the cycle.

As shown in FIG. 4, the shuttle valve spool remains in its left position. Rightward movement of the right diaphragm 19 evacuates (pumps) fluid from the right pumping chamber 23, and out the fluid pump exhaust. Rightward movement of the left diaphragm 18 draws fluid into the left pumping chamber 22 via the fluid pump intake. Rightward movement of the left diaphragm 18 also evacuates the left pneumatic chamber 20 through the left air fill line 26, the shuttle valve left pneumatic supply port 28, through the shuttle valve, and out the left exhaust port 34 to atmosphere.

As the drive shaft and diaphragms 18, 19 travel to the right, the drive shaft left annular groove 48 aligns with both the left drive shaft bore shift port 40 and the left drive shaft bore shuttle shift port 42, thereby establishing communication between the pressurized right pneumatic chamber 21, through the right chamber bleed port 37, the drive shaft bore left shift port 40 and shuttle shift port 42, through the left shuttle shift line 46, and the shuttle valve left shift port 44, permitting a blast of pressurized air in the pump right pneumatic chamber 21, which is in its pressure stroke, to exhaust to the left shuttle valve shift port 44, where it shifts the shuttle valve spool to its right position. This shifts the shuttle valve and fluid pump back to their first stage, as is shown in FIG. 1.

At this point in the cycle, the cycle repeats itself with the description of the FIG. 1 first stage of the cycle.

It will be appreciated that the present invention offers a number of improvements over pneumatically-actuated dual-reciprocating fluid pumps of the prior art. In the pump of the present invention, pneumatic pressure for shifting the reciprocating shuttle valve is taken from the pressure side, or pressure stroke, of the diaphragm pumping cycle. This has a number of advantages over prior art pneumatically-actuated fluid pumps. Specifically, taking pneumatic pressure from the diaphragm pumping stroke permits the pneumatic chamber to begin to bleed a predetermined amount of air pressure therefrom, prior to the end of the physical stroke of the drive shaft and diaphragms. This has a cushioning effect at the end of each pumping stroke by reducing the pneumatic pumping pressure slightly, immediately prior to the shift of the actuation pneumatic pressure from one pneumatic chamber to the other, thereby minimizing the effect of the drive shaft and diaphragms abruptly reversing direction at full air pressure. This reduction in the drive shaft and diaphragms abruptly reversing direction at full air pressure results in much smoother shifting and reciprocation of the diaphragms within the pump, and also reduces wear and fatigue on the pump components.

Second Embodiment

Those skilled in the art appreciate that many fluid pumps are utilized in an environment having back pressure forming a pressure head, as in when pumping liquid to a height of 30 feet or more or pumping into pressurized vessels. In these instances, it is preferable to override the drive shaft cushioning function provided by the first embodiment fluid pump invention, because overcoming the back pressure and pressure head requires all the positive pump pressure available. Therefore, rather than "steal" blasts of air from the pressurized pneumatic chamber during each pumping half-cycle, an "air-assist" mode is used. The air-assist mode utilizes an external source of pressurized air to shift the shuttle valve. Obviously, the shuttle valve will have to be shifted in synchronization with the fluid pump drive shaft and diaphragm. Therefore, the "air-assist" external air pressure source is provided directly to the pump body, and specifically directly to the drive shaft annular groove shifting mechanism.

FIGS. 7–12 illustrate a second embodiment 60 of the pneumatically-shifted reciprocating fluid pump and its associated shuttle valve. The theory of the second embodiment pump 60 and shuttle valve is the same as that of the first embodiment, with the following differences in the fluid pump.

Figure 5:
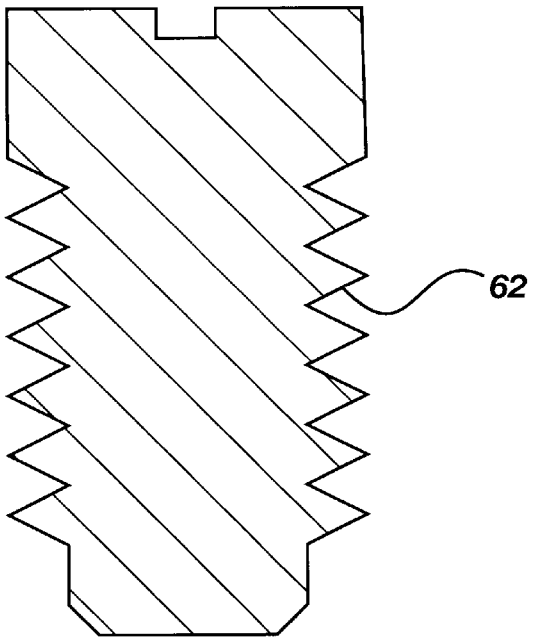
FIG. 5 is a sectional view of a first screw-plug used in the first embodiment pneumatically-shifted reciprocating fluid pump.

The first embodiment reciprocating fluid pump utilizes a pair of first screw-plugs 62, as shown in FIG. 5. These screw-plugs 62 isolate the pneumatic chamber chamber bleed ports 36, 37 and their corresponding drive shaft bore shift ports 41, 40 from atmosphere. In this manner, communication is always established only between the respective pneumatic chamber pressurized chamber bleed port 36,37 to its respective drive shaft bore shift port 40, 41.

Figure 6:
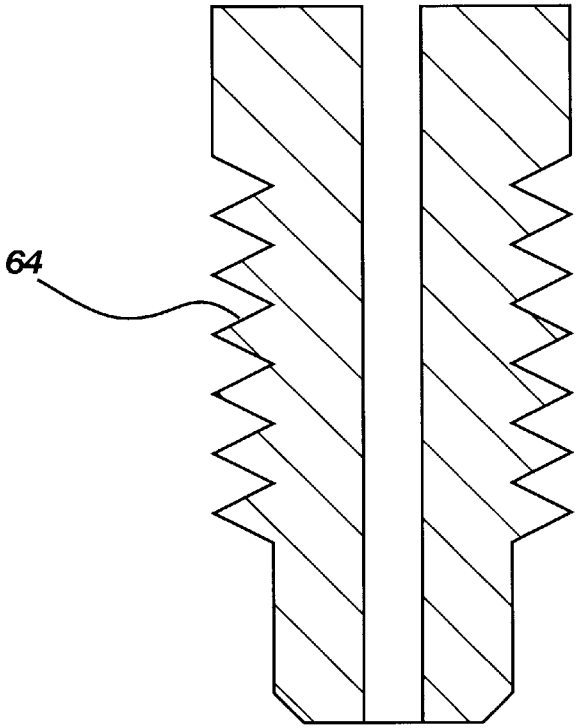
FIG. 6 is a sectional view of a second screw-plug used in the second embodiment pneumatically-shifted reciprocating fluid pump.

In the second embodiment, however, the screw-plug is replaced with a second embodiment screw-plug 64, shown in FIG. 6 that: (1) closes communication between the pneumatic chamber pressurized chamber bleed port 36, 37 and respective drive shaft bore shift ports 41, 40; and (2) establishes communication between the respective drive shaft bore shift port 40, 41 and an external source of pressurized air 66, 67. Therefore, in the "air-assist" mode (FIGS. 7–12), pressurized air is not "stolen" from the pressurized pneumatic chamber to shift the shuttle valve. Rather, this shuttle valve shifting air comes from the external air source 66, 67, through the drive shaft bore shift ports 40, 41, drive shaft annular grooves 48, 49, drive shaft bore shuttle shift ports 42, 43, shuttle shift lines 46, 47, and shuttle valve shift ports 44, 45. This shuttle valve shifting air for both sources 66 and 67 may, in fact, be a common source. Regardless, full pneumatic pressure is continuously applied to the respective pneumatic chambers 20, 21 during the pumping strokes, thereby maximizing the fluid pressure and flow out the pumping chambers 22, 23 of the fluid pump.

OPERATION

Figure 7:
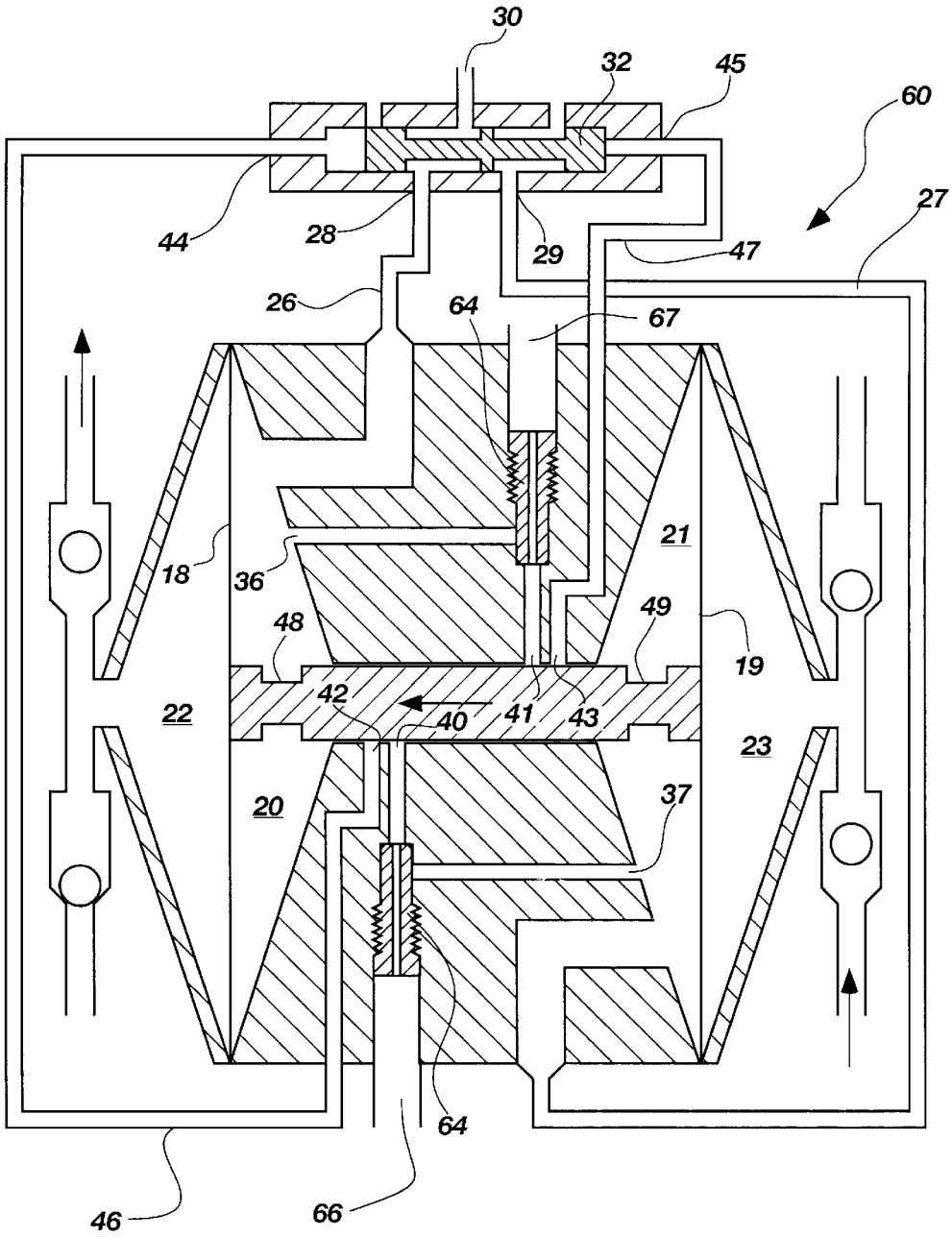
FIG. 7 is a schematic drawing of a second embodiment of the pneumatically-shifted reciprocating fluid pump and pneumatically-shifted shuttle valve, both shown in section, illustrating the pump and shuttle valve in a first of four stages of the pumping cycle.
Figure 8:
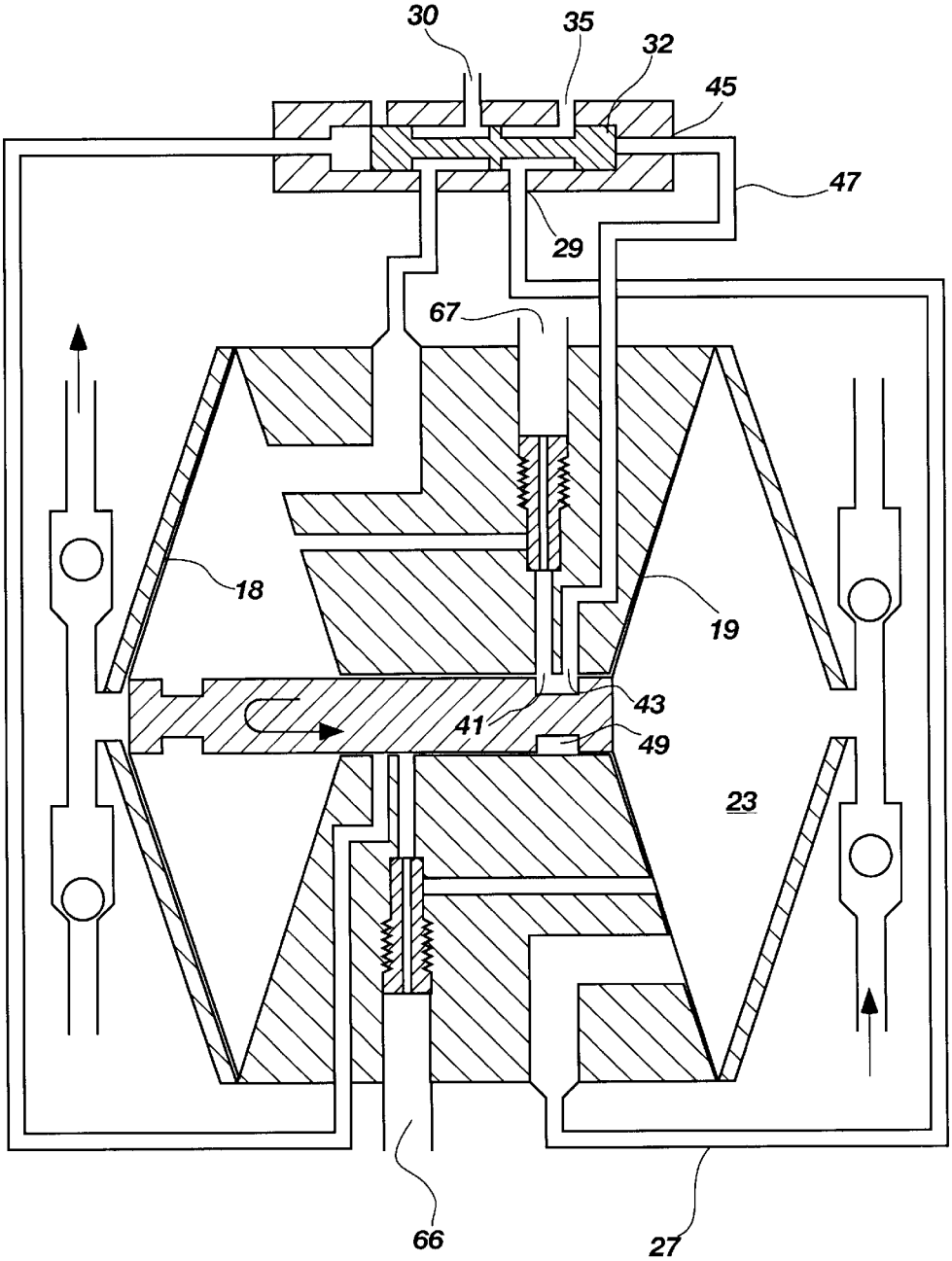
FIG. 8 is a schematic drawing similar to FIG. 7, illustrating the second embodiment pump and shuttle valve in the second stage of the cycle.

With reference to FIGS. 7–10, the operation of the second embodiment reciprocating fluid pump and shuttle valve will be explained. FIG. 7 illustrates the first stage of the pump and shuttle valve. The shuttle valve spool 32 is shown shifted to the right. High pressure air is introduced to the shuttle valve at the air inlet port 30, and passes through the valve to the left supply port 28, through the left air fill line 26, and into the left pneumatic chamber 20. The left pneumatic chamber 20 begins to fill under pneumatic pressure to expand, urging both diaphragms 18, 19 to the left. This is the pressure stroke of the left diaphragm 18 and intake stroke of the right diaphragm 19, evacuating liquid from the left pumping chamber 22 and drawing liquid into the right pumping chamber 23. This is shown in FIG. 8, which illustrates the second stage of the pump and shuttle valve.

As shown in FIG. 8, the shuttle valve spool 32 remains in its right position. Leftward movement of the left diaphragm 18 evacuates (pumps) fluid from the left pumping chamber 22, and out the fluid pump outlet. Leftward movement of the right diaphragm 19 draws fluid into the right pumping chamber 23 via the fluid pump intake. Leftward movement of the right diaphragm 19 also evacuates the right pneumatic chamber 21 through the right air fill line 27, the shuttle valve right pneumatic supply port 29, through the shuttle valve, and out the right exhaust port 35 to atmosphere.

Figure 9:
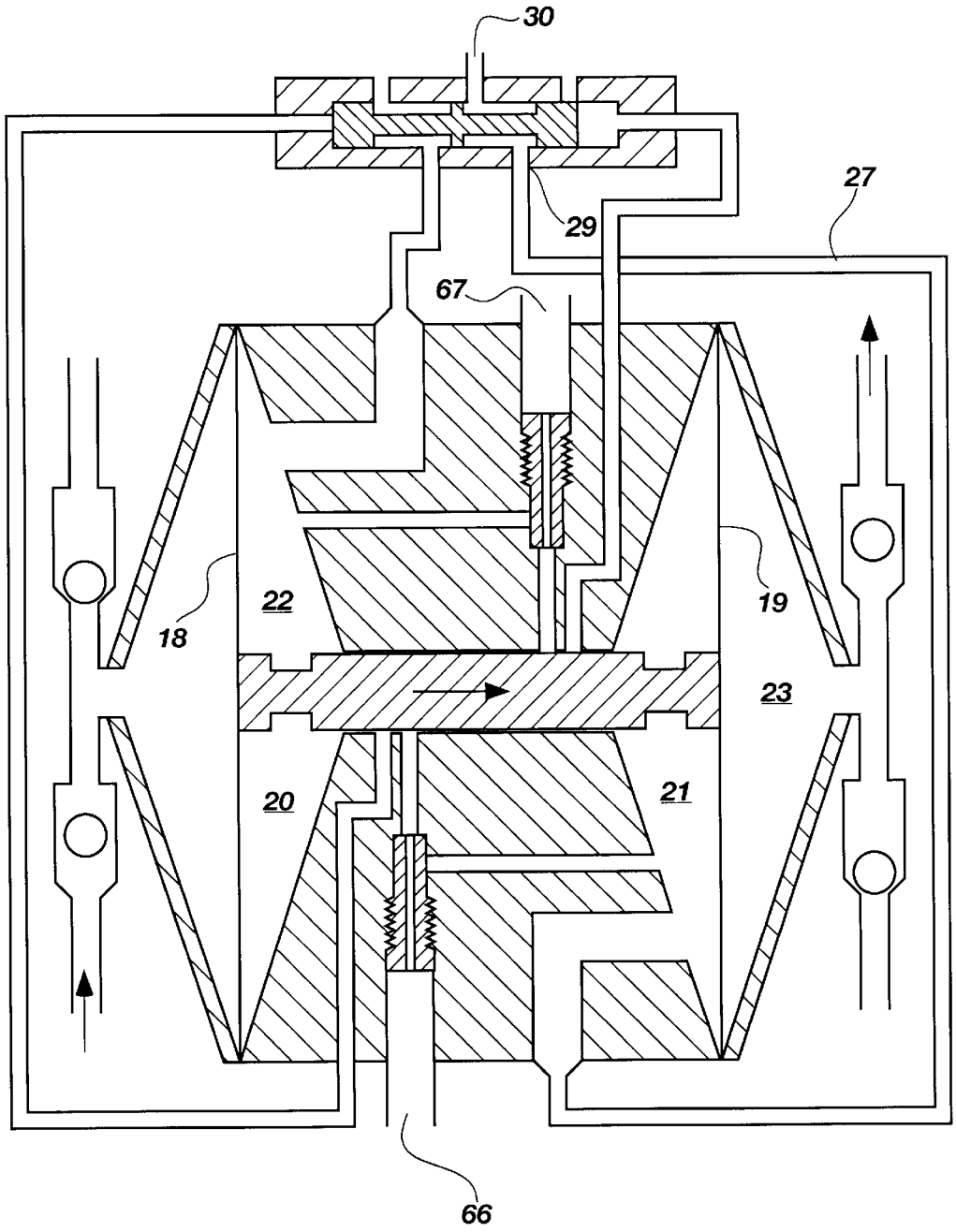
FIG. 9 is a schematic drawing similar to FIGS. 7 and 8, illustrating the second embodiment pump and shuttle valve in the third stage of the cycle.

As the drive shaft and diaphragms 18, 19 travel to the left, the drive shaft right annular groove 49 aligns with both the right drive shaft bore shift port 41 and the right drive shaft bore shuttle shift port 43, thereby establishing communication between the right external pressurized air source 67 and the shuttle valve right shift port 45, through the right drive shaft bore shift port 41, right drive shaft bore shuttle shift port 43, and right shuttle shift line 47, permitting a blast of pressurized air from the external pressurized air source 67 to shift the shuttle valve spool to its left position. This shifts the shuttle valve and fluid pump to their third stage, as is shown in FIG. 9.

With the shuttle spool in its left position (FIG. 9), high pressure air through the shuttle inlet port 30 is now directed to the right supply port 29, through the right air fill line 27, and into the right pneumatic chamber 21. The right pneumatic chamber 21 begins to fill under pneumatic pressure to expand, urging both diaphragms 18, 19 to the right. This is the pressure stroke of the right diaphragm 19 and intake stroke of the left diaphragm 18, evacuating liquid from the right pumping chamber 23 and drawing liquid into the left pumping chamber 22. This is shown in FIG. 10, which illustrates the fourth stage of the pump and shuttle valve.

Figure 10:
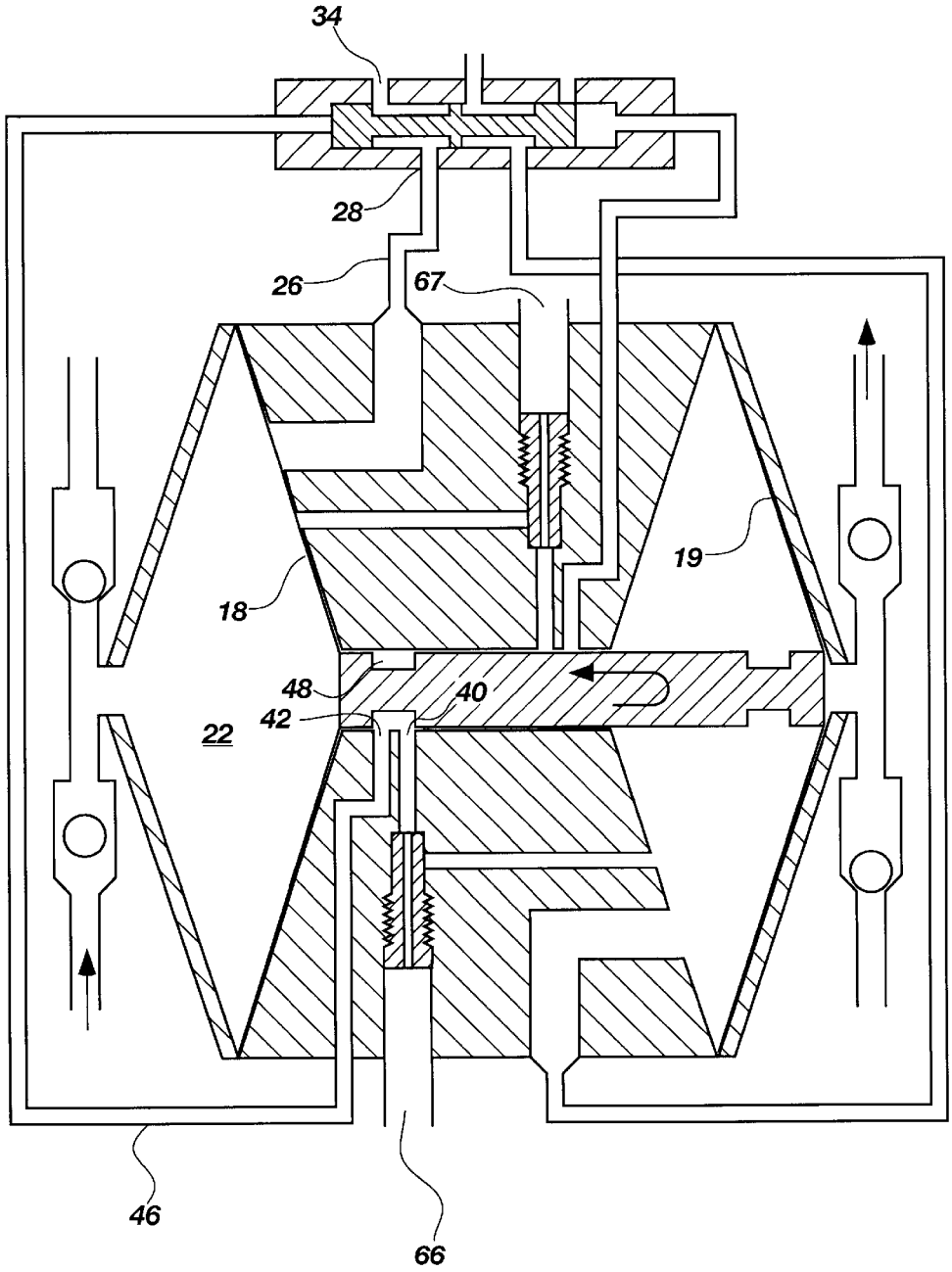
FIG. 10 is a schematic drawing similar to FIGS. 7–9, illustrating the second embodiment pump and shuttle valve in the fourth stage of the cycle.
Figure 11:
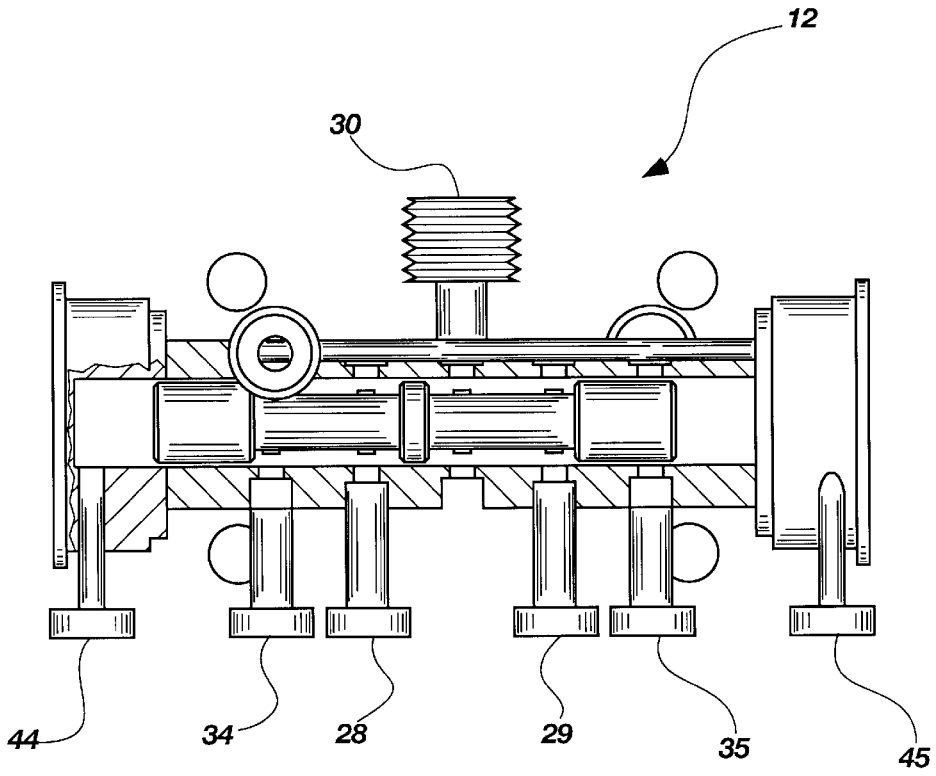
FIG. 11 is a schematic diagram of the best mode shuttle valve of the present invention.
Figure 12:
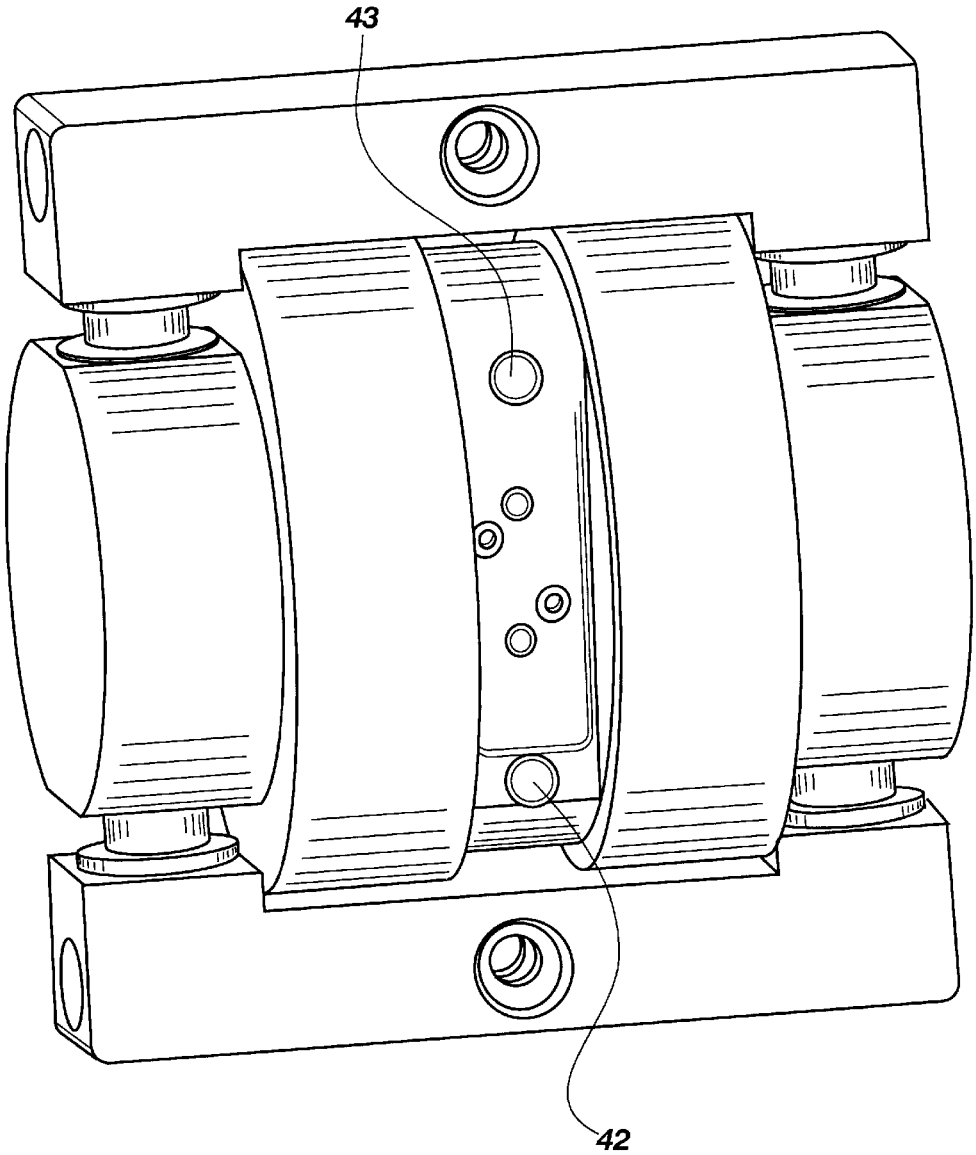
FIG. 12 is a computerized illustration of the best mode of the fluid pump, illustrating where the shuttle valve attaches to the pump body.

As shown in FIG. 10, the shuttle valve spool remains in its left position. Rightward movement of the right diaphragm 19 evacuates (pumps) fluid from the right pumping chamber 23, and out the fluid pump exhaust. Rightward movement of the left diaphragm 18 draws fluid into the left pumping chamber 22 via the fluid pump intake. Rightward movement of the left diaphragm 18 also evacuates the left pneumatic chamber 20 through the left air fill line 26, the shuttle valve left pneumatic supply port 28, through the shuttle valve, and out the left exhaust port 34 to atmosphere.

As the drive shaft and diaphragms 18, 19 travel to the right, the drive shaft left annular groove 48 aligns with both the left drive shaft bore shift port 40 and the left drive shaft bore shuttle shift port 42, thereby establishing communication between the external left pressurized air source 66 and the shuttle valve left shift port 44, through the left drive shaft bore shift port 40, left drive shaft bore shuttle shift port 42, and left shuttle shift line 46, permitting a blast of pressurized air from the external pressurized air source to shift the shuttle valve spool to its right position. This shifts the shuttle valve and fluid pump back to their first stage, as is shown in FIG. 7.

Figure 13:
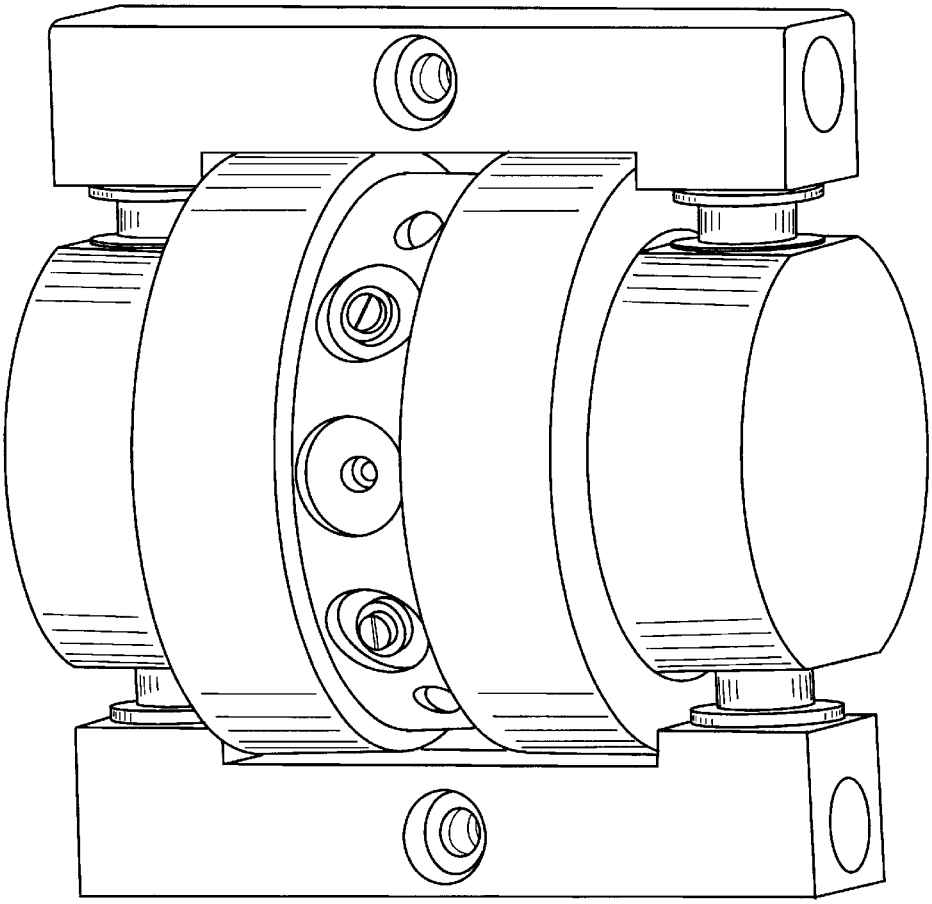
FIGS. 13 and 14 illustrate the accessibility of the screw-plugs for converting the fluid pump between air-assist and non-air-assist modes.
Figure 14:
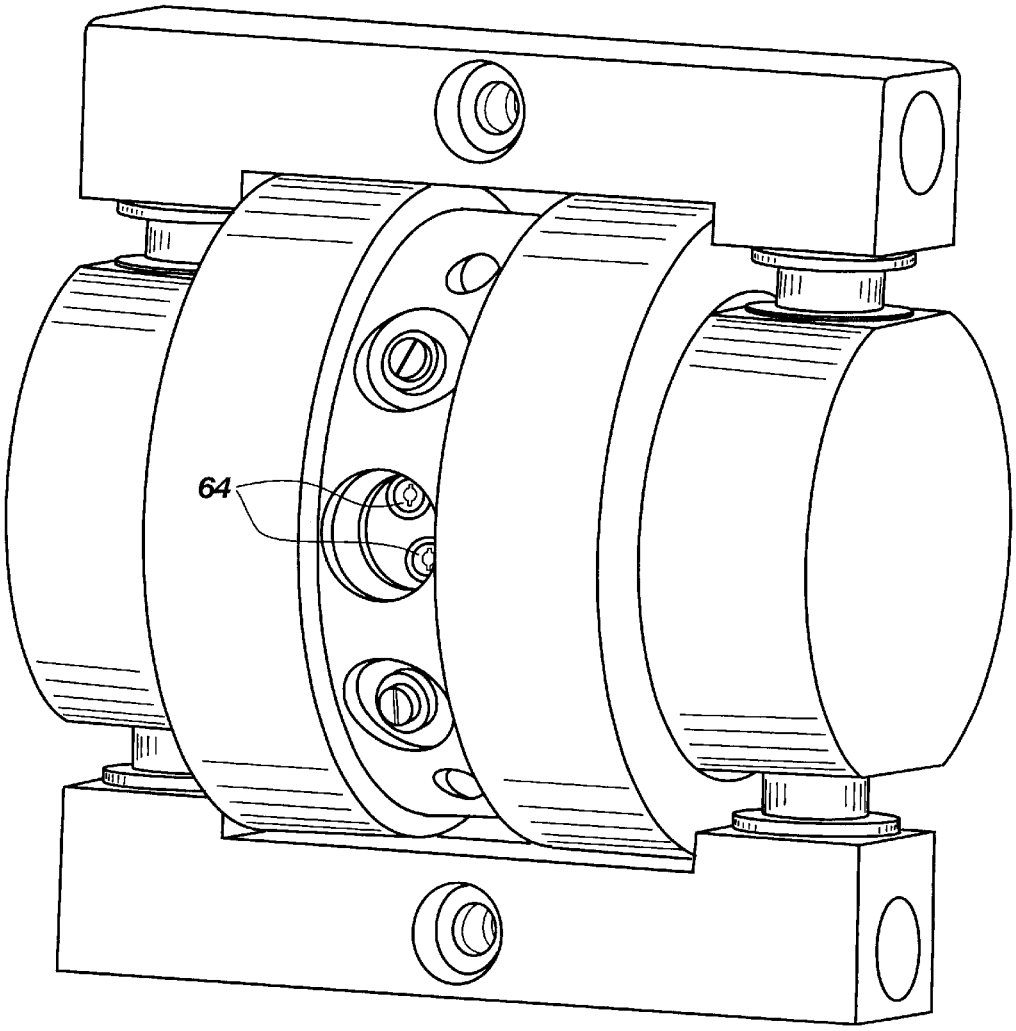
Figure 15:
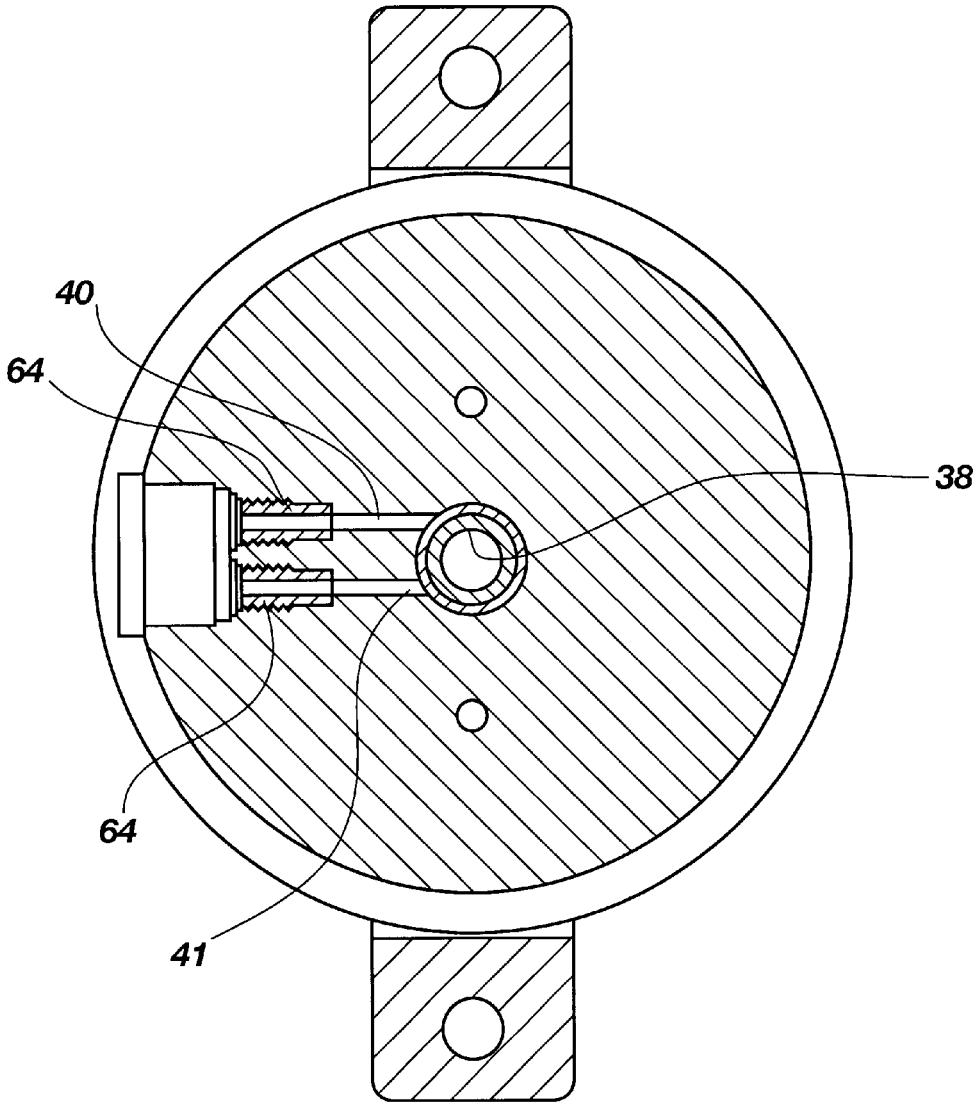
FIG. 15 illustrates the positioning of the air-assist ports within the pump body.

FIGS. 11–16 are representative drawings of the best mode of the fluid pump of the present invention, and illustrate that in this best mode, the shuttle valve is attachable directly to the fluid pump body (FIGS. 11 and 12), and the "air-assist" and non-air-assist screw-plugs 64,62 are positioned side-by-side in the pump body and are readily accessible (FIGS. 13–15).

Figure 16:
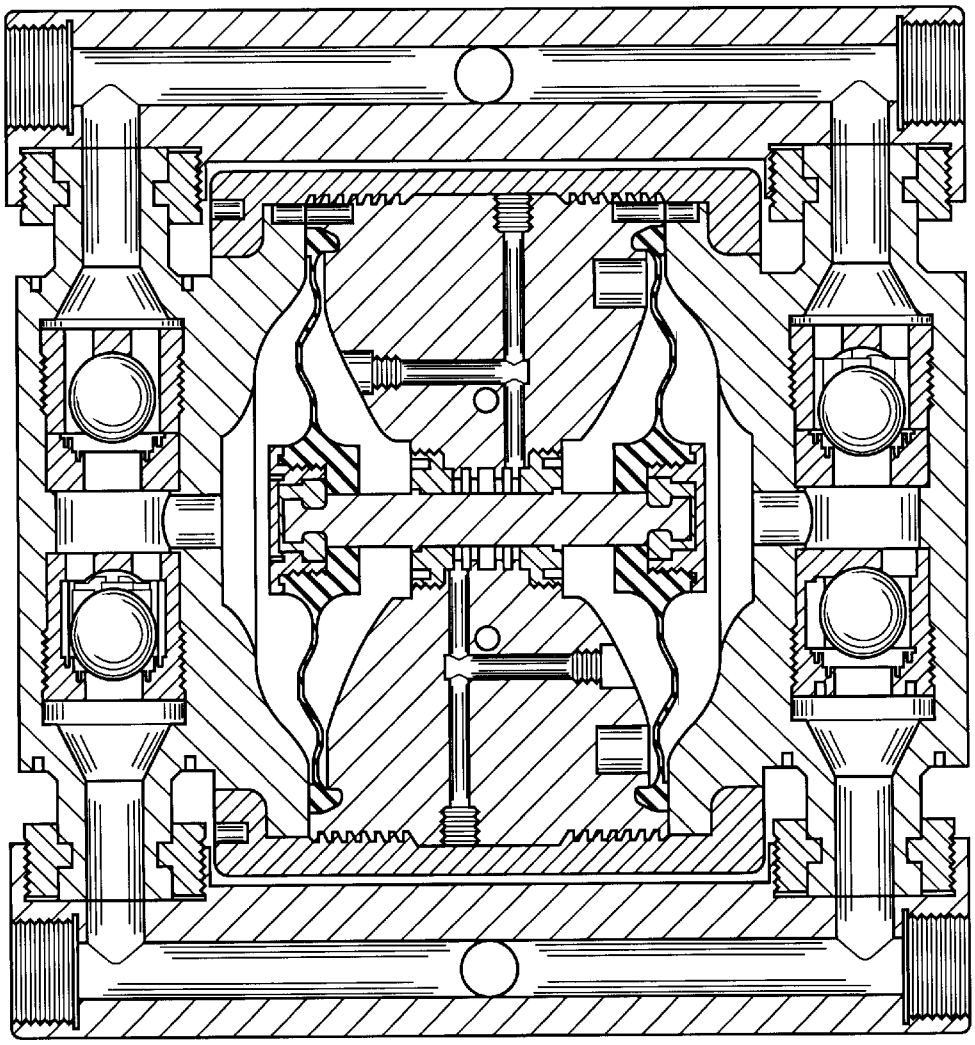
FIG. 16 is a cross-sectional view of the best mode of the fluid pump.

The present pneumatically-driven fluid pump may be made entirely of polytetrafluoroethylene (Teflon®) or similar material. Most pneumatically-driven fluid pumps, however, regardless of construction material, require a lubricant mixed in with the compressed air for lubricating the moving parts that define the shift mechanisms (shuttle valve, pump drive shaft and bushings, etc.). In addition, some pumps incorporate specific seals (e.g., O-rings) to effect the seals between moving parts, the seals, of course, introducing contamination into the system. The present invention obviates the necessity of introducing a separate lubricant (and therefore, contamination) into the compressed air by forming one or more of these moving parts from a ceramic material. Specifically, the drive shaft is formed of a ceramic material that reciprocates within a ceramic sleeve within the pump body. This is illustrated in FIG. 16. The ceramic sleeve fits within a central bore within the pump body, and is held in place by opposed rings or nuts that screw into the pump body. Those skilled in the art will readily appreciate that the ceramic sleeve includes the annular grooves 48, 49 that align with the various shift ports in the pump body, and these various annular grooves also include a plurality of radially oriented ports that establish communication between the respective shifting ports 40, 42 and 41, 43 and the drive shaft annular grooves 48, 49, regardless of angular orientation of the ceramic sleeve within the fluid pump body.

Likewise, the shuttle valve can be manufactured of a ceramic material. In both designs (drive shaft and sleeve, and the shuttle valve), the mating ceramic components are formed to a very high-tolerance slip fit that seals against air flow therebetween without the necessity of contaminating O-ring seals, for instance, while permitting the mating components to freely slide relative to each other without the necessity of contaminating lubricants from an outside source (e.g., the compressed air) or from the liquid being pumped, being introduced into the system.

Ceramic has a very low coefficient of thermal expansion, and also readily dissipates heat energy. Therefore, heat from friction generated during the reciprocating cyclic action of the drive shaft within the ceramic sleeve, and the spool valve element within the shuttle valve is readily dissipated by the ceramic, without the necessity for a cooling lubricant. Likewise, because the ceramic material does hot heat-expand, an additional lubricant in the compressed air for driving the pump and shuttle valve is not necessary. Therefore, the shifting mechanism is termed a "dry-shift" because the compressed air for driving the fluid pump and shuttle valve is dry, non-lubricated air.

Ceramic also has strong wear characteristics. Therefore, pump and shuttle valve ceramic parts will outlast non-ceramic parts, extending the life of the pump and obviating time-consuming and costly pump repair/replacement down-time.

From the foregoing, it will be seen that this invention is one well adapted to attain all of the ends and objectives herein set forth, together with other advantages which are obvious and which are inherent to the apparatus. It will be understood that certain features and subcombinations are of utility and may be employed with reference to other features and subcombinations. This is contemplated by and is within the scope of the claims. As many possible embodiments may be made of the invention without departing from the scope of the claims. It is to be understood that all matter herein set forth or shown in the accompanying drawings is to be interpreted as illustrative and not in a limiting sense.

LIST OF INDIVIDUAL ELEMENTS

10 reciprocating fluid pump
12 shuttle valve
14 housing
16 multidirectional flow mechanisms
18 left diaphragm
19 right diaphragm
22 left pump housing chamber
23 right pump housing chamber
20 left pneumatic chamber
21 right pneumatic chamber
22 left pumping chamber
23 right pumping chamber
24 drive shaft
26 left air fill line
27 right air fill line
28 shuttle valve left pneumatic supply port
29 shuttle valve right pneumatic supply port
30 air inlet port
32 shuttle valve spool
34 shuttle valve left exhaust port
35 shuttle valve right exhaust port
36 left chamber bleed port
37 right chamber bleed port
38 drive shaft bore
40 drive shaft bore left shift port
41 drive shaft bore right shift port
42 left drive shaft bore shuttle shift port
43 right drive shaft bore shuttle shift port
44 left shuttle valve shift port
45 right shuttle valve shift port
46 left shuttle shift line
47 right shuttle shift line

48 left annular groove
49 right annular groove
50 shuttle valve spool bore
52 shuttle valve spool center element
60 second embodiment reciprocating fluid pump
62 screw-plugs
64 second embodiment screw-plugs
66 left external pressurized air source
67 left external pressurized air source
68 left drive shaft air port
69 right drive shaft air port

What is claimed is:

1. A pneumatically shifted reciprocating fluid pump comprising:

a body defining two pumped fluid pumping chambers;

driving means defining a pneumatically driven driving chamber associated with each respective pumped fluid pumping chamber;

connecting means connecting the respective driving means; and a pneumatically actuated control valve for supplying a first drive fluid sequentially to each pneumatically actuated driving chamber for effecting reciprocal pumping of the respective driving means, wherein the pump is convertible between two modes of operation wherein in a first mode the pump includes first pneumatically actuated switching means associated with each respective driving means for permitting drive fluid to selectively exhaust from respective pneumatically actuated driving chambers to shift the control valve for sequentially supplying the drive fluid to respective pneumatically actuated driving chambers for reciprocally actuating respective pumping chambers;

and a second mode wherein the pump includes second pneumatically actuated switching means associated with the connecting means for permitting an external supply of drive fluid to selectively shift the control valve for sequentially supplying the external supply of drive fluid to respective pneumatically actuated driving chambers for reciprocally actuating respective pumping chambers.

2. The reciprocating fluid pump of claim 1 wherein in the first mode, drive fluid is supplied from the driving chamber through a valving mechanism incorporated into the pump body and driving means.

3. The reciprocating fluid pump of claim 1 wherein in the second mode, drive fluid is supplied from the external supply of drive fluid through a valving mechanism incorporated into the pump body and driving means.

4. The reciprocating fluid pump of claim 3 wherein the external supply of drive fluid is the same as the first drive fluid.

5. The reciprocating fluid pump of claim 3 wherein the external supply of drive fluid is independent of the first drive fluid.

6. The reciprocating fluid pump of claim 1 wherein the pump is constructed totally of polytetrafluoroethylene or similar material.

7. The reciprocating fluid pump of claim 5 wherein in the second mode, the external supply of drive fluid is common to both respective pump pneumatic actuated driving chambers.

8. The reciprocating fluid pump of claim 1 wherein the pump is readily interchangeable between its first and second operational modes by replacing a first-mode drive fluid plug with a second-mode drive fluid plug in both pump body pump driving means.

9. The reciprocating fluid pump of claim 1 wherein the pneumatically actuated driving and pumping chambers are defined by respective flexible diaphragms positioned within the pump body to separate respective pumped fluid pumping chambers from respective pneumatically driven driving chambers.

10. A pneumatically shifted reciprocating fluid pump comprising:

a body defining two pumped fluid pumping chambers;

driving means defining a pneumatically driven driving chamber associated with each respective pumped fluid pumping chamber;

connecting means connecting the respective driving means; and a pneumatically actuated control valve for supplying a first drive fluid sequentially to each pneumatically actuated driving chamber for effecting reciprocal pumping of the respective driving means, wherein the pump is convertible between two modes of operation wherein in a first mode the pump includes exhaust means for permitting drive fluid to selectively exhaust from respective pneumatically actuated driving chambers to slow down the connecting means as the connecting means nears the end of its stroke in order to cushion the impact of the connecting means within the pump body;

and a second mode wherein the exhaust means is disabled.

11. The reciprocating fluid pump of claim 10 wherein in the first mode, drive fluid is supplied from the driving chamber through a valving mechanism incorporated into the pump body and driving means.

12. The reciprocating fluid pump of claim 10 wherein in the second mode, drive fluid is supplied from the external supply of drive fluid through a valving mechanism incorporated into the pump body and driving means.

13. The reciprocating fluid pump of claim 12 wherein the external supply of drive fluid is the same as the first drive fluid.

14. The reciprocating fluid pump of claim 12 wherein the external supply of drive fluid is independent of the first drive fluid.

15. The reciprocating fluid pump of claim 10 wherein the pump is constructed totally of polytetrafluoroethylene or similar material.

16. The reciprocating fluid pump of claim 14 wherein in the second mode, the external supply of drive fluid is common to both respective pump pneumatic actuated driving chambers.

17. The reciprocating fluid pump of claim 10 wherein the pump is readily interchangeable between its first and second operational modes by replacing a first-mode drive fluid plug with a second-mode drive fluid plug in both pump body pump driving means.

18. The reciprocating fluid pump of claim 10 wherein the pneumatically actuated driving and pumping chambers are defined by respective flexible diaphragms positioned within the pump body to separate respective pumped fluid pumping chambers from respective pneumatically driven driving chambers.

* * * * *